United States Patent [19]

Latino

[11] 4,247,999

[45] Feb. 3, 1981

[54] MEANS FOR STORING AND INDEXING MICROFICHE

[75] Inventor: Richard M. Latino, Worcester, Mass.

[73] Assignee: Wright Line Inc., Worcester, Mass.

[21] Appl. No.: 67,952

[22] Filed: Aug. 20, 1979

[51] Int. Cl.[3] ..... G42F 21/00; B65D 27/00

[52] U.S. Cl. ..... 40/359; 40/2 R; 40/159; 283/36

[58] Field of Search ..... 40/2 R, 359, 360, 16, 40/124.1, 405, 375, 405, 489, 490, 159, 156, 158 R, 158 B; 283/18, 19, 20, 21, 36, 37, 38, 39, 40, 41

[56] References Cited

U.S. PATENT DOCUMENTS

| | | | |
|---|---|---|---|
| 1,462,825 | 7/1923 | Ringler | 283/18 X |
| 2,202,268 | 5/1940 | Rohlfes | 40/16 X |
| 3,001,306 | 9/1961 | Wilkinson | 40/360 |
| 3,555,713 | 1/1971 | Leinbach | 40/405 |
| 3,626,619 | 12/1971 | Boedeker | 40/360 |
| 4,052,807 | 10/1977 | Schweinberg | 40/359 |
| 4,143,477 | 3/1979 | Reynolds | 40/359 |

FOREIGN PATENT DOCUMENTS

| | | | |
|---|---|---|---|
| 1151590 | 1/1958 | France | 40/405 |
| 262565 | 7/1949 | Switzerland | 283/41 |
| 1179522 | 1/1970 | United Kingdom | 40/359 |

*Primary Examiner*—Gene Mancene
*Assistant Examiner*—G. Lee Skillington
*Attorney, Agent, or Firm*—Milton E. Gilbert

[57] ABSTRACT

A novel type of preprinted index strip is disclosed for use in microfiche storage panels and similar devices of the type adapted to hold and display index strips along one edge. This new type of index strip greatly expands the choice of identification symbols available to the user from a single preprinted index sheet without requiring a reduction in the size of the identification symbols or prohibiting the same identification symbol from being displayed on both sides of the storage panel.

7 Claims, 7 Drawing Figures

MEANS FOR STORING AND INDEXING MICROFICHE

BACKGROUND OF THE INVENTION

Microfiche storage panels and similar devices are well known in the art. These panels typically comprise a relatively flat member provided with a plurality of compartments for receiving the articles to be stored, with an assortment of punched holes running along one edge of the member to facilitate storage of the panel in a binder arrangement. Another edge, preferably the one opposing the edge with the punched holes, is typically formed of a transparent material in the shape of a hollow profile edge. This hollow profile edge is adapted to receive and display an index strip which is used for panel identification purposes. A typical storage panel of the type described is shown in U.S. Pat. No. 4,052,807.

The index strip, which usually runs along the entire length of the storage panel, may be either blank or preprinted. Where the strip is blank, the user simply writes in by hand the desired identifying information. It is sometimes preferable, however, to have the index strips preprinted with identification symbols. These strips allow the user to simply select one or more identification symbols for storage panel identification, with the selected symbol or symbols being displayed on both sides of the storage panel. U.S. Pat. No. 4,052,807 discloses one such preprinted index strip.

Preprinted index strips of the type disclosed in U.S. Pat. No. 4,052,807 suffer from the disadvantage that the set of available identification symbols is limited to those that can be fit in one column of the index strip, since the parallel second column must exactly duplicate the first column's symbols if the selected identification symbol or symbols is to be displayed on both sides of the storage panel. As a result, in order to increase the number of available identification symbols when using index strips of the type disclosed in U.S. Pat. No. 4,052,807, the identification symbols must either be made smaller in size or more than one index strip must be prepared. However, there is a practical limit to the desired size of the identifying symbols. Hence, increasing the number of symbols is most practically achieved by preparing a number of preprinted index strips so as to meet the needs of the user.

One of the objects of the present invention is to provide an index strip which greatly expands the choice of identification symbols available to the user from a single preprinted index sheet without requiring a reduction in the size of the identification symbols or prohibiting the selected identification symbol from being displayed on both sides of the storage panel.

Another object of the present invention is to provide preprinted index strips which are cheap to produce and easy to use.

Yet another object of the present invention is to provide index strips which are particularly well suited to use with alphanumeric identification symbols.

SUMMARY OF THE INVENTION

These and other objects are addressed by the present invention, which in its preferred embodiment comprises a single sheet of material rectangular in shape and perforated lengthwise along two lines so as to create three vertical columns and perforated along a plurality of transverse lines so as to create a plurality of horizontal rows. In this way the rectangular sheet is subdivided into a grid arrangement, where each of the identifying symbols will occupy one block of the grid.

On one side of the sheet the left-hand vertical column is covered with a solid color field, the middle vertical column is printed with a first vertical sequence of identification symbols, and the right-hand vertical column is printed with a second vertical sequence of identification symbols. On the reverse side of the sheet the same pattern is repeated. Then, when a user wishes to employ the index sheet, he folds the strip along the vertical perforations so that only the solid color fields will remain exposed. Once this is done, the user may manipulate the strip further so as to selectively expose on both sides of the strip any identification symbol within either vertical sequence. The index strip may then be inserted into a storage panel.

DETAILED DESCRIPTION OF THE PREFERRED EMBODIMENT

Figure 1:
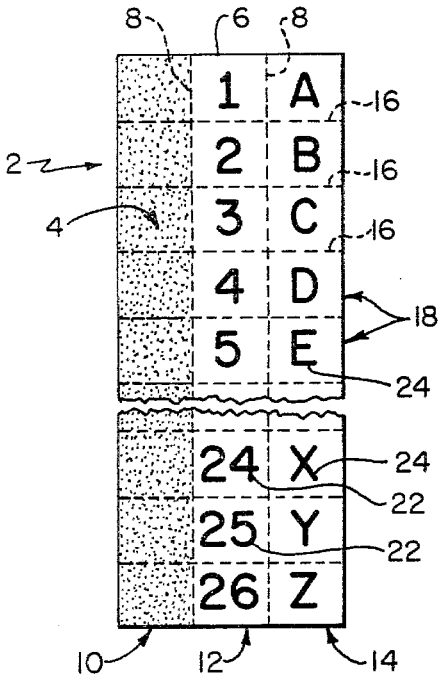
FIG. 1 is a top plan view showing the front side of the preferred embodiment of the present invention.

Referring first to FIG. 1, it will be seen that the printed index strip generally comprises a firm rectangular sheet 2 having a front surface 4 and a top end 6. Sheet 2 is preferably formed out of firm paper or a similar material and is perforated along its long axis by a pair of vertical perforation lines 8 so as to be divided into three equally-spaced vertical columns 10, 12 and 14. Sheet 2 is also perforated along its short axis by a plurality of horizontal perforation lines 16 so as to be divided into a number of equally-spaced horizontal rows 18. In this way sheet 2 is effectively subdivided into the grid arrangement shown.

Still referring to FIG. 1, it will be seen that the front surface 4 of sheet 2 has the vertical column 10 shaded with a solid color field 20. The middle vertical column 12 has a first vertical sequence of identification symbols 22 printed in each of the grid blocks of that column, and the vertical column 14 has a second vertical sequence of identification symbols 24 printed in each of its grid blocks. It should be noted that while in the preferred embodiment the identification symbols of the first vertical sequence 22 consist of numerical symbols and the identification symbols of the second vertical sequence 24 consist of alpha symbols, other symbols may be substituted.

Figure 2:
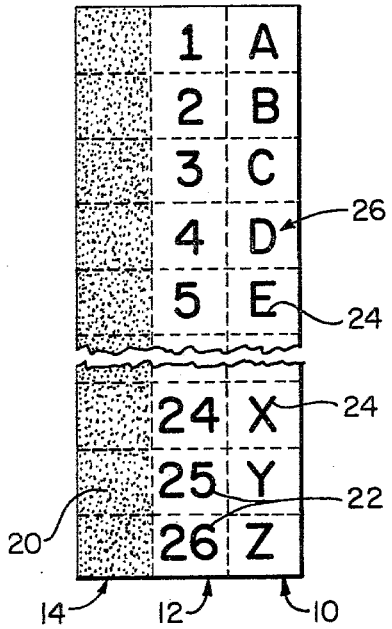
FIG. 2 is a top plan view showing the reverse side of the preferred embodiment.

FIG. 2 shows the rear surface 26 of sheet 2. Vertical column 10 (appearing now on the right hand side of sheet 2 instead of the left as in FIG. 1) has the second vertical sequence 24 of identification symbols printed on each of the grid blocks of that column. Note how each symbol of the vertical sequence 24 appears in the same horizontal row here as it does in vertical column 14 on front surface 4. Similarly, vertical column 12 has the first vertical sequence 22 printed on each of the grid blocks of that column on its reverse side 26, with each symbol of the vertical sequence 22 appearing in the same horizontal row here as it does in vertical column 12 on front surface 4. In addition, vertical column 14 (appearing now on the left hand side of sheet 2 instead of on the right as in FIG. 1) is shaded with the solid color field 20. As a result, it will be seen that vertical column 10 has the solid color field 20 on its front face 4 and the second vertical sequence 24 on its rear surface 26, vertical column 14 has the second vertical sequence 24 on its front surface 4 but the solid color field 20 on its rear face 26, and the vertical column 12 has the first vertical sequence 22 on both its sides.

Sheet 2 is designed to be used in the following manner. First the sheet is folded along its vertical perforation lines 8 so that only the solid color fields 20 are exposed. This is achieved by bringing the front surface 4 of column 14 (provided with the second vertical character sequence 24) against the front surface 4 of column 12 (provided with the first vertical character sequence 22) so that the rear surface 26 of column 14 (with its solid color field 20) is exposed to the view of the user. Next, the rear surface 26 of column 10 (with the second vertical sequence of characters, 24) is brought against the rear surface 26 of column 12 (provided with the first vertical sequence of characters, 22) so that only the solid color field 20 on side 26 of column 14 will be exposed. Such an arrangement is shown in FIG. 3.

Figure 4:
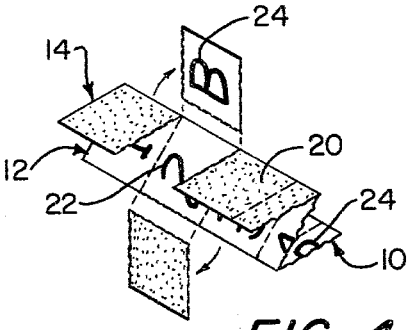

Now the user decides if he wishes to expose a symbol from first vertical sequence 22 or second vertical sequence 24. If the user decides to expose a symbol from vertical sequence 22, he must first determine the horizontal row 18 in which that symbol is located. Then he proceeds to tear along the horizontal perforations 16 which define that row and the vertical perforations 8 defining vertical column 12 until that row has only its center block left and the desired symbol is exposed. See FIG. 4 where the numeral "2" has been exposed in the foregoing manner. It will be noted that when the foregoing procedure is followed, the color fields will be exposed on both sides of the folded strip for their entire lengths except for the locations where the symbol has been exposed.

Figure 3:
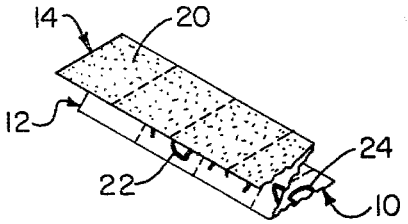
FIGS. 3, 4, 5, and 5A are partial perspective views showing the preferred embodiment in various stages of manipulation.
Figure 5:
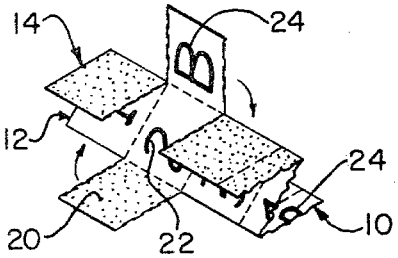
Figure 5A:
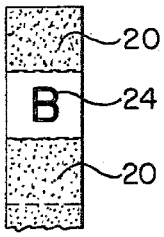

In the event that the user wishes to expose a symbol from the second vertical sequence 24 instead of a symbol from the first vertical sequence 22, a slightly different procedure is used (see FIGS. 3, 5 and 5A). Once again the sheet 2 is folded along its vertical perforations 8 until only the solid color fields 20 are exposed (FIG. 3). Then the user proceeds to locate the symbol desired for identification and again tears along the horizontal perforations 16 which define the row in which the symbol is located until the vertical perforation lines 8 are encountered. Next, the user simply folds along the vertical perforations 8 until the desired symbol is visible. See FIGS. 5 and 5A. As FIG. 5A indicates, the selected symbol will be visible from both sides of the folded index strip when this is done.

Figure 6:
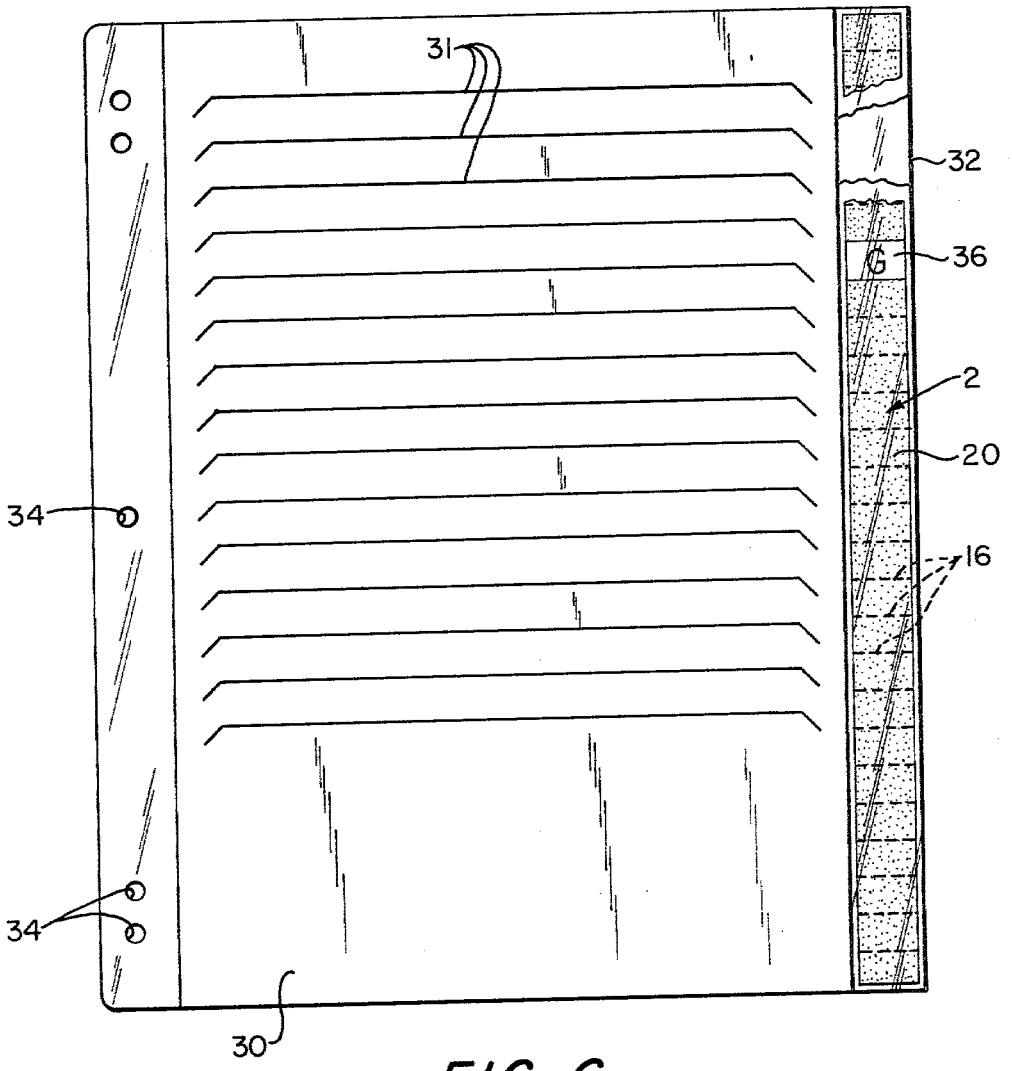
FIG. 6 shows a top plan view with a selected portion cut away of a typical microfiche storage panel with index strip in place.

Once the strip 2 has been folded along its vertical perforation lines 8 and the desired symbol exposed, the strip is ready for deployment with the microfiche storage panel or similar storage device which is to be identified via the indexing strip. FIG. 6 shows such an arrangement. The microfiche storage panel typically comprises a flat member 30 which is provided with a plurality of pockets 31 for holding microfiche cards. Flat member 30 is also typically provided with a hollow profile edge 32 which is formed of transparent material and sized so as to receive the folded index strip 2. Essentially the profile edge 32 is a flat sleeve with a flange secured to the free edge of the microfiche panel. The sleeve is open at both ends to permit insertion and withdrawal of the folded index strip. In this way when the folded index strip is inserted into the profile edge and the flat member 30 is mounted in a binder via the binder holes 34, an identification symbol 36 will be visible on both sides of the microfiche storage panel to mark the panel for easy identification.

It should be appreciated that the preferred embodiment described herein is provided merely for the sake of example and clarification and should in no way be construed as limiting the scope of the present invention, since additional modifications of this embodiment are possible without departing the scope of this invention. Thus, for example, a user might choose to expose two symbols from the index strip 2 instead of just one as shown. Also one may omit the center portions of the horizontal perforation lines 16 so that the vertical column 12 is formed void of horizontal perforation lines. This will result in an index strip which has greater firmness when folded along its vertical perforation lines 8 so as to allow easier insertion into the profile edge 32 of the microfiche storage panel. Or a user might choose to print symbols other than the alphanumeric ones used to create vertical sequences 22 and 24. Alternatively, one or both of the vertical sequences 22 or 24 could be comprised of both alpha and numeric symbols. These and other changes of their type will be obvious to one skilled in the art.

It will readily be seen that the present invention exhibits a number of advantages over the prior art. First, the present invention discloses a method of greatly expanding the choice of identification symbols available to the user from a single preprinted index sheet without requiring a reduction in the size of the identification symbols or prohibiting the selected identification symbol from being displayed on both sides of the storage panel. In addition, the index strips disclosed are cheap to make and easy to use. Furthermore, by having two different vertical symbol sequences available for identification purposes rather than a single vertical symbol sequence as is normally the case, the present system renders itself particularly useful for alphanumeric filing systems. And it will be noted that when the symbol which is to be exposed is a symbol in the second vertical sequence of symbols, the strip suffers no permanent transformation and may be reused again with no ill effects (see FIG. 5). These and other advantages will be obvious to one skilled in the art.

What is claimed is:

1. Storage means for storing one or more sheets of microfiche or similar articles, said means comprising:

(a) a relatively flat member provided with a plurality of pockets therein for receiving and releasably holding said sheets, said flat member being provided with a transparent sleeve running along one edge thereof;

(b) an index strip for disposition within said sleeve, said strip comprising a flat member having a top, a bottom, a front and a back, and being subdivided into first, second and third equally-spaced vertical columns by a pair of first lines of perforations, said first and third vertical columns outlying said second vertical column and said first and third vertical columns being each subdivided into a plurality of identical rectangular blocks by an equal number of equally-spaced second lines of perforations, said second lines of perforations in said first and third columns being aligned with one another so as to define a series of horizontal rows, and further wherein the first vertical column on said front side is covered with a solid color field, the second vertical column on said first side is covered with a first vertical sequence of symbols, the third column on the front side is covered with a second vertical sequence of symbols, the first vertical column on said rear sides is covered with said second vertical sequence of symbols, the second vertical column on said rear side is covered with said first vertical sequence of symbols, and the third vertical column on the rear side is covered with said solid color field, with the symbols of said first and second vertical sequence being substantially uniformly located along said vertical columns and along said horizontal rows, whereby when said flat member is folded along said first lines of perforations so that only said solid color fields are exposed to view, (a) any selected symbol of said first vertical sequence of symbols may be exposed to view by first determining in which of said horizontal rows said selected symbol lies and then tearing along said first lines of perforations and said second lines of perforations so as to remove from said horizontal row all portions of said first and third vertical columns, and (b) any selected symbol of said second vertical sequence may be exposed to view by tearing along said second lines of perforations and folding along said first lines of perforations until said selected symbol is exposed.

2. Storage means according to claim 1 wherein said transparent sleeve and said index strip are sized to run along the entire length of said one edge.

3. An index strip according to claim 1 wherein said second lines of perforations extend through said second vertical column.

4. An index strip comprising a flat member having a top, a bottom, a front and a back, and subdivided into first, second and third equally-spaced vertical columns by a pair of first lines of perforations, said first and third vertical columns outlying said second vertical column and said first and third vertical columns being each subdivided into a plurality of identical rectangular blocks by an equal number of equally-spaced second lines of perforations, said second lines of perforations in said first and third columns being aligned with one another so as to define a series of horizontal rows, and further wherein the first vertical column on said front side is covered with a solid color field, the second vertical column on said first side is covered with a first vertical sequence of symbols, the third column on the front side is covered with a second vertical sequence of symbols, the first vertical column on said rear sides is covered with said second vertical sequence of symbols, the second vertical column on said rear side is covered with said first vertical sequence of symbols, and the third vertical column on the rear side is covered with said solid color field, with the symbols of said first and second vertical sequence being substantially uniformly located along said vertical columns and along said horizontal rows, whereby when said flat member is folded along said first lines of perforations so that only said solid color fields are exposed to view, (a) any selected symbol of said first vertical sequence of symbols may be exposed to view by first determining in which of said horizontal rows said selected symbol lies and then tearing along said first lines of perforations and said second lines of perforations so as to remove from said horizontal row all portions of said first and third vertical columns, and (b) any selected symbol of said second vertical sequence may be exposed to view by tearing along said second lines of perforations and folding along said first lines of perforations until said selected symbol is exposed.

5. An index strip according to claim 4 wherein said first vertical sequence of symbols comprises alpha symbols and said second vertical sequence of symbols comprises numeric symbols.

6. An index strip according to claim 4 wherein said first vertical sequence of symbols comprises numeric symbols and said second vertical sequence of symbols comprises alpha symbols.

7. An index strip according to claim 4 wherein said second lines of perforations extend through said second vertical column.

* * * * *